US005595278A

United States Patent [19]

Ostermeier et al.

[11] Patent Number: 5,595,278

[45] Date of Patent: Jan. 21, 1997

[54] PALLET FOR A CONVEYOR

[75] Inventors: Jörg Ostermeier; Peter Borchers; Bernward Engelke, all of Stadthagen, Germany

[73] Assignee: Otis Elevator Company, Farmington, Conn.

[21] Appl. No.: 430,949

[22] Filed: Apr. 28, 1995

[51] Int. Cl.[6] ..... B66B 23/12

[52] U.S. Cl. ..... 198/333; 198/327; 198/326

[58] Field of Search ..... 198/321, 326, 198/327, 333

[56] References Cited

U.S. PATENT DOCUMENTS

| | | | |
|---|---|---|---|
| 406,314 | 7/1889 | Souder | 198/327 |
| 739,141 | 9/1903 | Baltzley | 198/333 X |
| 4,565,276 | 1/1986 | Dengs et al. | 198/321 |
| 4,645,059 | 2/1987 | Höfling et al. | 198/321 |
| 5,033,606 | 7/1991 | Matoba et al. | 198/333 X |
| 5,137,135 | 8/1992 | Pietsch et al. | 198/332 |
| 5,293,982 | 3/1994 | Ahls et al. | 198/332 |

FOREIGN PATENT DOCUMENTS

| | | | |
|---|---|---|---|
| 0443039 | 8/1991 | European Pat. Off. | B66B 21/08 |
| 2305367 | 4/1974 | France | B65G 17/34 |
| 2248406 | 10/1976 | Germany | B65G 17/06 |
| 0510029 | 7/1939 | United Kingdom | 198/326 |
| 2243133 | 10/1991 | United Kingdom | 198/321 |

*Primary Examiner*—James R. Bidwell

[57] ABSTRACT

A pallet for a conveyor includes a first connector, a second connector, and a link engaging the connectors of adjacent pallets. The link permits the connectors of adjacent pallets to move relative to each other through an arcuate path. This arrangement for adjacent pallets results in a connection between the pallets that accommodates the varying distance between the adjacent pallets as they travel through a curved path.

10 Claims, 1 Drawing Sheet

PALLET FOR A CONVEYOR

TECHNICAL FIELD

The present invention relates to conveyors, and more particularly to pallets for such conveyors.

BACKGROUND OF THE INVENTION

Passenger conveyors, such as escalators and moving walks, are well known and efficient devices for transporting people. Escalators are typically used to transport people vertically, such as from one floor of a building to another, and moving walks are more commonly used to transport people horizontally from one point to another in a linear fashion. Some applications for moving walks do require elevation changes and, as a result, have curved sections in the path of travel to provide the needed change in elevation.

As the latter applications become more prevalent, there is a need to provide pallets that can traverse both the linear sections of the path and the curved sections. The need for elevation changes encourages the use of shorter pallets. Shorter pallets accommodate smaller radii in the curved sections. Shorter pallets, however, may become cost prohibitive as the quantity of pallets required for a given length of walk increases.

A typical moving walk is comprised of a truss, a drive sprocket, an idler sprocket, a pair of pallet chains, and a plurality of pallets extending sequentially between and attached to the pallet chains. The drive sprocket engages the pallet chains to drive them through a continuous loop that includes the idler sprocket at the opposite end. The pallet chain includes sequentially coupled chain links and a plurality of rollers that ride in a pair of roller tracks.

Conventional pallets are connected to the pallet chain in one of two methods. The first method is to use a pair of puller wheels disposed on an axle along the forward edge of the pallet. The axle provides support for the forward edge of the pallet and is engaged with the pallet chain to move the pallet with the pallet chain. The wheel may be integral to the pallet chain or may ride in a separate track. The aft edge of the pallet is supported by a second axle having a pair of trailer rollers. The trailer rollers ride in a pair of trailer roller tracks and are not rigidly coupled to the pallet chain. Separate trailer roller tracks are needed to accommodate the curvature of the path of travel as the pallet assembly goes around the sprocket. This method adds complexity and cost to the moving walk as a result of the additional roller track required for the trailer rollers.

The second method uses a sliding block device rather than trailer rollers to accommodate the curvature of the sprocket. In this device, the loads on the aft edge of the pallet are supported by a pin or block that is engaged with a slot on the forward edge of the adjacent pallet. The slot permits the pin or block to move axially while supporting vertical loads on the pallet. Axial movement of the pin or block allows the pallets to move relative to each other as they travel around the sprocket. This method requires a sprocket having significant radial dimension due to the practical limitation on the amount of movement permitted by the sliding block device. This problem is accentuated by shorter pallets that may only extend two chain links. In addition, the sliding engagement between the slot and the block is a source of noise, wear and vibration within the moving walk.

The above art notwithstanding, scientists and engineers under the direction of Applicant's Assignee are working to develop conveyors that minimize cost while providing a durable device that minimizes vibration and noise.

Disclosure of the Invention

According to the present invention, a pallet for a passenger conveyor includes a first connector, a second connector, and means to engage the first connector with a second connector of an adjacent pallet. The engagement means permits the connectors to move through an arcuate path relative to each other.

According to a specific embodiment of the present invention, the first connector is an axle disposed along one edge of the pallet and the second connector is a pin disposed along the opposite edge of the pallet. The axle is engaged with the pin of the adjacent pallet by a link that permits the pin and the axle to rotate about each other. The pallet includes support structure having a first recess adjacent to the axle and a second recess adjacent the pin. The recesses provide space for the relative motion between the pins and axles.

As the pallet travels through a curved section of the path, the pins rotate about the axles to which they are connected such that the distance between axles of adjacent pallets decreases. This decrease in separation between adjacent axles accommodates the curvature of the pallet chain as it travels along the curved section.

One advantage of the present invention is the simplicity and minimal cost of the kinematic arrangement relative to using trailer rollers on each pallet and an additional set of roller tracks. Mother advantage is the durability of the invention relative to passenger conveyors using the sliding block type arrangement. Wearing contact is minimized and, as a result, noise and vibration are reduced. Further, in curved sections of the path the separation between adjacent pallets is minimized.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
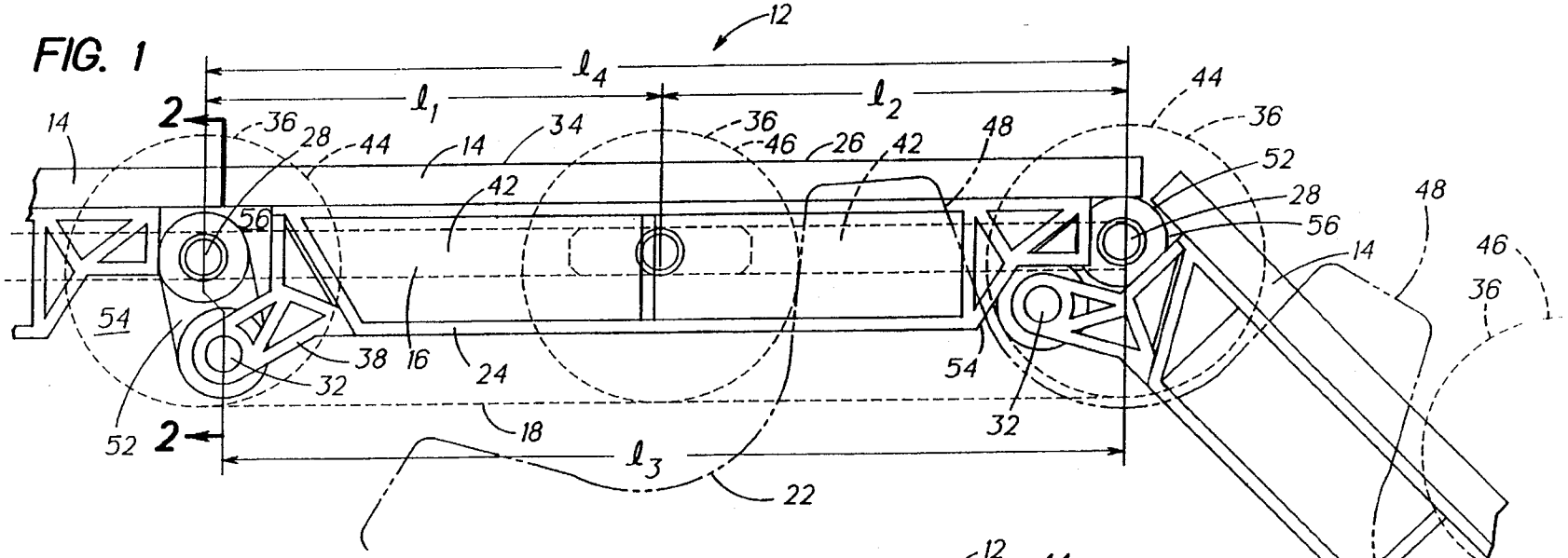
FIG. 1 is a side view of adjacent pallets with a pallet chain, rollers and roller track shown in dashed lines.
Figure 2:
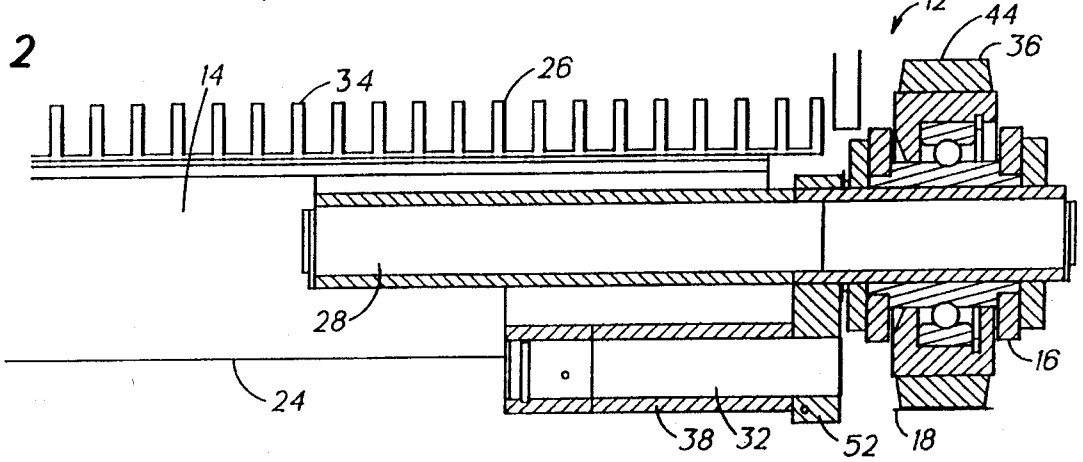
FIG. 2 is a sectional view taken along line 2—2 of FIG. 1.

A passenger conveyor 12 is illustrated in FIGS. 1 and 2. The passenger conveyor 12 includes a plurality of pallets 14 sequentially connected to form a pallet assembly, a pallet chain 16, a roller track 18, and a sprocket 22.

Each of the pallets 14 includes a support frame 24, a treadplate 26, a pair of roller axles 28, and a pair of pins 32. The support frame 24 provides a rigid structure to support the loads carried by the pallets 14 during operation. The treadplate 26 is attached to the support frame 24 and defines a surface 34 for the passengers riding the conveyor. The pair of roller axles 28 are disposed on the front edge of the pallet 14 and each is engaged with a roller 36. Each of the pins 32 is connected to the support frame 24 by an extension 38 projecting from the aft edge of the pallet 14.

The pallet chain 16 includes a plurality of the rollers 36 spaced apart and interconnected by a plurality of chain links 42. The plurality of rollers 36 includes puller rollers 44 and idler rollers 46. The puller rollers 44 are engaged with the roller axles 28 of the pallets 14. The idler rollers 46 are interspaced between adjacent puller rollers 44 and connected to opposing ends of adjacent chain links 42.

The roller track 18 extends along the length of the passenger conveyor 12 and defines a path for the plurality of rollers 36.

The sprocket 22 is located at the end of the passenger conveyor 12 and provides means to turn the pallet assembly and the pallet chain 16 within its loop of travel. The sprocket 22 includes a plurality of radially outward extending teeth 48 that engage the chain links 42 in a conventional manner to rotate the pallet chain 16 and thereby the pallet assembly.

Adjacent pallets 14 are connected via a pair of links 52. Each link 52 is engaged with the roller axle 28 of one pallet 14 and the pin 32 of the adjacent pallet 14. The link 52 is permitted rotational motion about both the roller axle 28 and the pin 32.

During operation of the passenger conveyor 12, the pallet assembly is pulled through an endless loop by the pallet chain 16, which as described previously is engaged with the pallets 14 through the puller rollers 44. In portions of the loop that are linear, adjacent pallets 14 are positioned as shown in the left hand side of FIG. 2. The pin 32 of one pallet 14 is directly below the roller axle 28 of the adjacent pallet 14 and the link 52 is generally in a vertical orientation to minimize loading on the link 52 that results from passenger load on the pallets 14. The chain links 42 are aligned and the distance $l_4$ separating puller rollers 44 is equal to the sum of the lengths $l_1$ and $l_2$ of the separation between puller rollers 44 and idler rollers 46. The length $l_3$ of the pallet 14, as measured from the center of the roller axle 28 to the center of the pin 32, is constant.

Once the pallet assembly moves into a curved section of the loop, several kinematic events take Place. First, adjacent chain links 42 are no longer aligned and now approximate the radius of the curved section as they travel around it. Second, and as a result of the curvature of the pallet chain 16, the opposite ends of adjacent chain links 42 are less distant from each other in curved sections than in linear sections. Since the lengths $l_1$ and $l_2$ of the chain links 42 do not change, and since the pallets 14 are rigid and length $l_3$ does not change, the shortening of the distance $l_4$ between adjacent puller rollers 28 requires accommodation.

This accommodation of the change in length $l_4$ as the pallet assembly travels around the sprocket 22 is provided by the arrangement of the roller axles 28, pins 32, and links 52. As the pallets 14 travel onto the sprocket 22, the roller axle 28 and connected pin 32 rotate through an arcuate path relative to each other. As shown in the right hand side of FIG. 1, the pin 32 of the forward pallet 14 moves into a recess 54 in the forward edge of the support frame 24 of the aft pallet 14 and the roller axle 28 of the aft pallet 14 moves into a complimentary recess 56 in the aft edge of the forward pallet 14. The recesses 54, 56 are sized appropriately to permit the full range of relative motion needed by the roller axles 28 and pins 32.

The roller axles 28, pins 32, and links 54 are convenient and effective means of connecting adjacent pallets in a manner permitting adjacent pallets to move through a curved path while at the same time maintaining a rigid connection between the adjacent pallets. Other types of connectors and means of engagement may be used to produce the arcuate relative motion between the connectors and thereby accommodate the shortening of the distance $l_4$. In addition, the link may be formed from a rigid material, i.e., a metal, or from a more elastic material.

Although shown and described in FIGS. 1 and 2 as a conveyor having pallets that extend only the length of two chain links, it should be readily apparent to one skilled in the art that the invention disclosed herein is equally applicable to conveyors having pallets that extend over three or more chain links. Using a greater number of links reduces the polygon effect associated with the pallet chain traveling around the sprocket (resulting in less change in dimension $l_4$) at the expense of increasing the cost of the additional links.

Although the invention has been shown and described with respect to exemplary embodiments thereof, it should be understood by those skilled in the art that various changes, omissions, and additions may be made thereto, without departing from the spirit and scope of the invention.

What is claimed is:

1. A pallet for a conveyor having a plurality of adjacent pallets connected to and driven by a pallet chain, the conveyor including a path having a linear section and a curved section for the plurality of pallets, the pallet including:

a first connector disposed on a first edge of the pallet;

a second connector disposed on a second edge of the pallet, the second edge being opposite to the first edge; and means to engage the first connector with a second connector of an adjacent pallet such that the first and second connectors connected by the engagement means are permitted to move relative to each other through an arcuate path, wherein the relative motion between the first and second connectors of adjacent pallets in the curved section of the path permits the first and second connectors to move towards the adjacent pallet.

2. The pallet according to claim 1, wherein the first connector is an axle, the axle being in a fixed relationship with the pallet chain for motion therewith, and the second connector is a pin.

3. The pallet according to claim 1, wherein the relative motion between the first and second connectors of adjacent pallets permits the distance between the first connectors of adjacent pallets in the curved section of the path to be less than the distance between the first connectors of adjacent pallets in the linear section of the path.

4. The pallet according to claim 1, wherein the means to engage the first connector with the second connector of an adjacent pallet is a link engaged with the first connector for rotation about the first connector and engaged with the second connector for rotation about the second connector.

5. The pallet according to claim 1, further including a support frame, the support frame including a first recess along the first edge of the pallet and a second recess along the second edge of the pallet, such that during relative motion of the first and second connectors the first connector moves through the second recess of the adjacent pallet and the second connector of the adjacent pallet moves through the first recess.

6. A conveyor having a plurality of adjacent pallets connected to and driven by a pallet chain, the pallet chain including a plurality of sequentially coupled chain links, the plurality of pallets connected to the pallet chain such that two or more chain links separate adjacent pallets, the conveyor including a path having a linear section and a curved section for the plurality of pallets, each of the pallets including:

a first connector disposed on a first edge of the pallet;

a second connector disposed on a second edge of the pallet, the second edge being opposite to the first edge such that the second connector is proximate to the first connector of an adjacent pallet; and means to engage the first connector with the second connector of the adjacent pallet such that the first and second connectors connected by the engagement means are permitted to move relative to each other through an arcuate path, wherein the relative motion between the first and second connectors of adjacent pallets in the curved section of the path permits the first and second connectors to move towards the adjacent pallet.

7. The conveyor according to claim 6, wherein the first connector is an axle, the axle being in a fixed relationship with the pallet chain for motion therewith, and the second connector is a pin.

8. The conveyor according to claim 6, wherein the relative motion between the first and second connectors of adjacent pallets permits the distance between the first connectors of adjacent pallets in the curved section of the path to be less than the distance between the first connectors of adjacent pallets in the linear section of the path.

9. The conveyor according to claim 6, wherein the means to engage the first connector with the second connector of an adjacent pallet is a link engaged with the first connector for rotation about the first connector and engaged with the second connector for rotation about the second connector.

10. The conveyor according to claim 6, further including a support frame, the support frame including a first recess along the first edge of the pallet a second recess along the second edge of the pallet, such that during relative motion of the first and second connectors the first connector moves through the second recess of the adjacent pallet and the second connector of the adjacent pallet moves through the first recess.

* * * * *